US005794577A

United States Patent [19]

Kira

[11] Patent Number: 5,794,577

[45] Date of Patent: Aug. 18, 1998

[54] VALVE TIMING CONTROL DEVICE

[75] Inventor: Naoki Kira, Aichi-pref., Japan

[73] Assignee: Aisin Seiki Kabushiki Kaisha, Aichi-pref, Japan

[21] Appl. No.: 893,482

[22] Filed: Jul. 11, 1997

[30] Foreign Application Priority Data

Jul. 12, 1996 [JP] Japan ..... 8-183515

[51] Int. Cl.[6] ..... F01L 1/344

[52] U.S. Cl. ..... 123/90.17; 123/90.31; 74/568 R; 464/2

[58] Field of Search ..... 123/90.15, 90.17, 123/90.31; 74/567, 568 R; 464/1, 2, 160

[56] References Cited

U.S. PATENT DOCUMENTS 4,858,572 8/1989 Shirai et al. ..... 123/90.12

5,450,825 9/1995 Geyer et al. ..... 123/90.17

*Primary Examiner*—Weilun Lo

*Attorney, Agent, or Firm*—Hazel & Thomas

[57] ABSTRACT

A valve timing control device has a rotor fixed on a cam shaft of an engine and a housing member ratably mounted on the cam shaft. The housing member surrounds the rotor. A chamber defined between the housing member and the rotor has a pair of circumferentially opposed walls. A vane is mounted on the rotor and extends outwardly therefrom in the radial direction into the chamber so as to divide the chamber into a first pressure chamber and a second pressure chamber. A plate spring is inserted between the rotor and the vane and a fluid supplying device supplies fluid under pressure to at least a selected one of the first pressure chamber and the second pressure chamber.

8 Claims, 4 Drawing Sheets

VALVE TIMING CONTROL DEVICE

FIELD OF THE INVENTION

The present invention relates to a valve timing control device and, in particular, to a valve timing control device for controlling an angular phase difference between a crank shaft and a cam shaft of a combustion engine.

BACKGROUND OF THE INVENTION

In general, a valve timing of an internal combustion engine is determined by a valve mechanism driven by cam shafts in accordance with either a characteristic or a specification of the internal combustion engine. When a condition of combustion is changed in response to the rotational speed of the combustion engine, however, it is difficult to obtain an optimum valve timing through the whole rotational range of the engine. Therefore, a valve timing control device which changes a valve timing in response to the condition of the internal combustion engine has been proposed as an auxiliary mechanism for the valve mechanism in recent years.

A conventional device of this kind is disclosed, for example, in U.S. Pat. No. 4,858,572. In this device, a rotor is fixed on the cam shaft. A drive member is rotatably mounted on the cam shaft so as to surround the rotor. The drive member is driven by the rotational torque provided by a crank shaft. A plurality of chambers are provided between the drive member and the rotor and each of the chambers has a pair of circumferentially opposed walls. A plurality of vanes are mounted onto the rotor and extended outwardly in the radial direction into the chambers so as to divide each of the chambers into a first pressure chamber and a second pressure chamber. A plurality of coil springs are located between the vanes and the rotor and extended outwardly in the radial direction. In this device, fluid under pressure is supplied to a selected one of the first pressure chamber and the second pressure chamber in response to the running condition of the internal combustion engine and an angular phase difference between the crank shaft and the cam shaft is controlled so as to advance or retard the valve timing relative to the crank shaft. The fluid under pressure is supplied by an oil pump. The valve timing control device is in the position of the maximum advanced condition, when each of the vanes contacts with one of the opposed walls of each of the chambers. On the other hand, the valve timing control device is in the position of the maximum retarded condition, when each of the vanes contacts with the other of the opposed walls of each of the chambers.

In the above mentioned prior device, the drive member is like cylindrical shape. The rotor which is also like cylinder shape is inserted into the drive member. The coil spring is located in a hole of the vane. The hole is made at the inside end of the vane and extends inwardly therefrom. The length of the coil spring is longer than the length of the hole so that the coil spring pushes the vane toward the drive member. When assembling the valve timing control device, first the rotor is fixed to the cam shaft, second a plurality of the coil springs is inserted into the holes of the vane, third a plurality of the vanes is fitted onto the holes against the repel power of the coil spring, and then the rotor with the vanes is inserted into the drive member. In these, steps, however, the rotor has to he inserted into the drive member very slowly and carefully in order to avoid twisting the coil spring.

SUMMARY OF THE INVENTION

Accordingly, it is an object of the present invention to provide an improved valve timing control device without the foregoing drawbacks.

In accordance with the present inventions valve timing control device has a rotor fixed on a cam shaft of an engine and a housing member rotatably mounted on the cam shaft. The housing member surrounds the rotor. A chamber defined between the housing member and the rotor has a pair of circumferentially opposed walls. A vane is mounted on the rotor and extends outwardly therefrom in the radial direction into the chamber so as to divide the chamber into a first pressure chamber and a second pressure chamber. A plate spring is inserted between the rotor and the vane and a fluid supplying means supplies fluid under pressure to at least a selected one of the first pressure chamber and the second pressure chamber.

Other objects and advantages of the invention will become apparent during the following discussion of the accompanying drawings.

BRIEF DESCRIPTION OF THE DRAWING FIGURES

The foregoing and additional features of the present invention will become more apparent from the following detailed preferred embodiments thereof when considered with reference to the attached drawings, in which.

DETAILED DESCRIPTION OF THE PREFERRED EMBODIMENTS

A valve timing control device in accordance with preferred embodiment of the present invention will be described with reference to the attached drawings.

Figure 1:
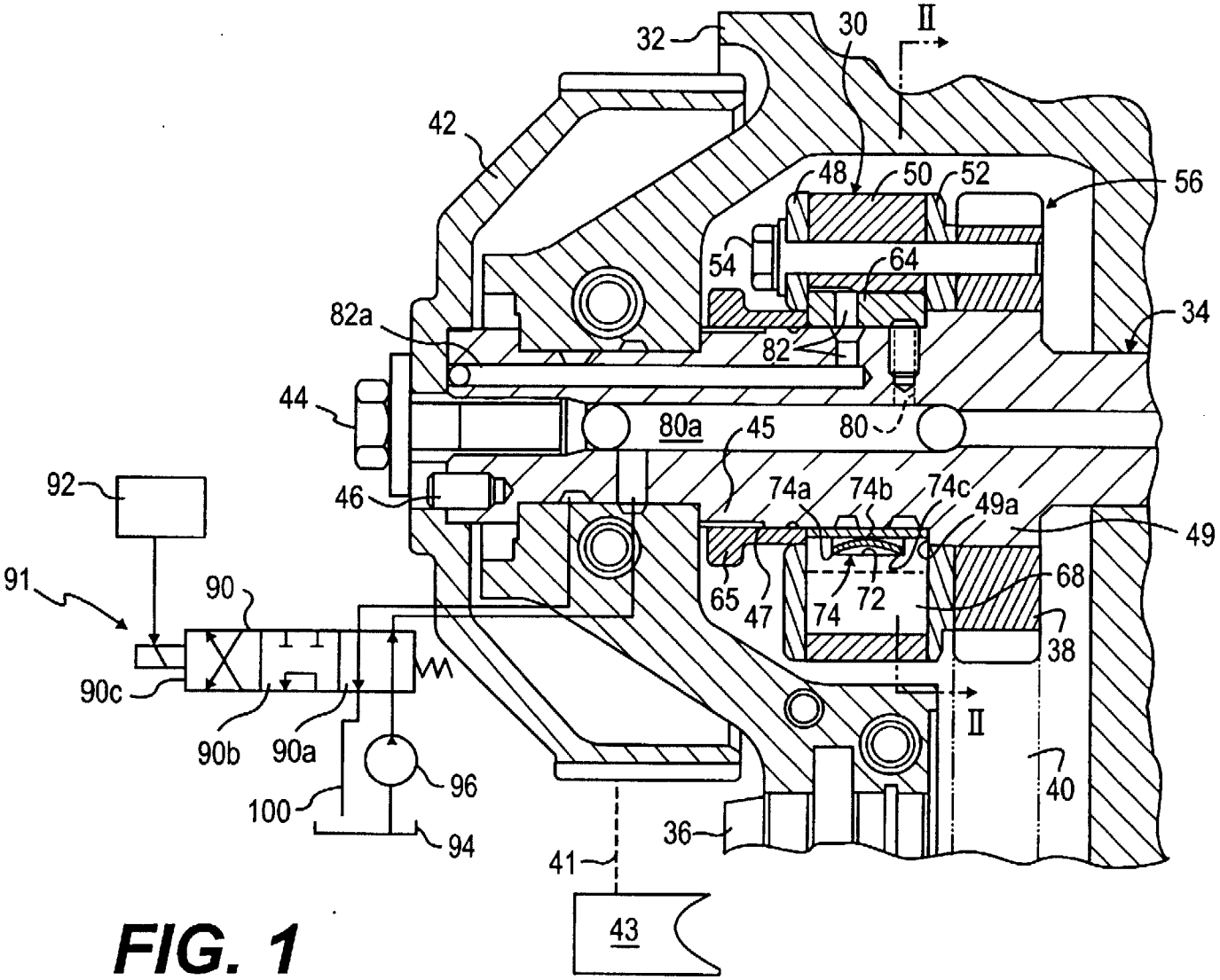
FIG. 1 is a sectional view of the embodiment of a valve timing control divide in accordance with the present invention.
Figure 2:
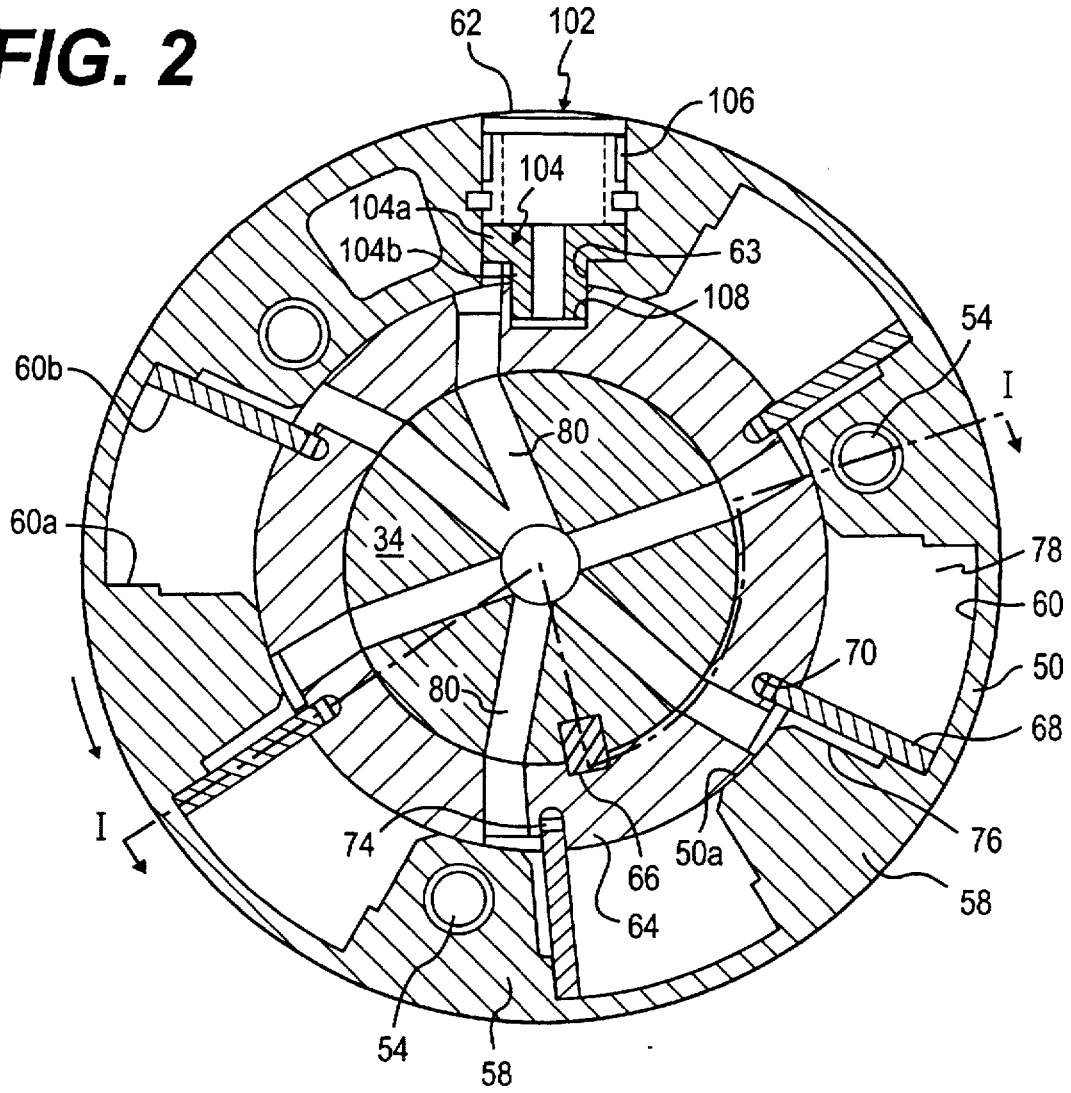
FIG. 2 is a section view taken along the line II—II in FIG. 1 in accordance with the present invention.
Figure 3:
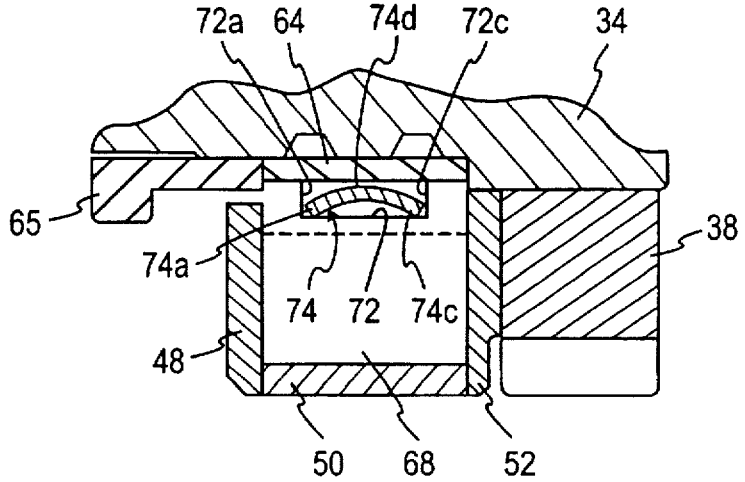
FIG. 3 is a sectional view, on an enlarged scale, of a portion of the plate spring in FIG. 1.

FIGS. 1 to 3 show a first embodiment of the present invention. In this first embodiment, a valve timing control device according to the present invention is applied to an engine of DOHC (Double Over Head Cam Shaft) type.

Referring to FIG. 1, an exhaust cam shaft 34 and an intake cam shaft 36 are rotatably mounted on a cylinder head 32 of an engine and are connected each other by gears 38 and 40. The gear 38 is rotatably mounted on the exhaust cam shaft 34 and the gear 40 is rotatably mounted on the intake cam shaft 36.

An end of the exhaust cam shaft 34 projects out of the cylinder head 32 and a timing pulley 42 is fixed to the projecting end of the exhaust cam shaft 34 by a bolt 44. A stopper pin 46 is fixed to the projecting end of the exhaust cam shaft 34 and is fitted into a notch formed on the timing pulley 42 so that the relative rotation between the timing pulley 42 and the exhaust cam shaft 34 is prevented. Rotational torque is transmitted to the timing pulley 42 via a belt 41 from a crank shaft 43 which is rotated by the engine.

A cylindrical portion 45 of the exhaust cam shaft 34 extends into the cylinder head 32 and is provided with a male screw portion 47 on which a male screw is formed. A journal portion 49 has a larger diameter than that of the cylindrical portion 45. On the journal portion 49, the gear 38 which has three female screw holes which are penetrated in the circumferential direction at regular intervals is rotatably mounted thereon.

On the cylindrical portion 45 of the exhaust cam shaft 34, a valve timing control mechanism 30 is mounted thereon. As shown in FIGS. 1 and 2, the valve timing control mechanism 30 includes a rotor 64, five vanes 68, a housing member 50, a circular front plate 48 and a circular rear plate 52. The rotor 64 is a cylindrical shape and is fixedly mounted on the cylindrical portion 45 of the exhaust cam shaft 34. The housing member 50 is a cylindrical shape with an inner bore 50*a* and is rotatably mounted on the outer circumferential surface of the rotor 64 so as to surround the rotor 64. The housing member 50 has the same axial length as the rotor 64 and is provided with five grooves 60 which outwardly extend from the inner bore 50*a* in the radial direction and are separated in the circumferential direction at regular intervals. The housing member 50 are also provided with three holes which are penetrated in the axial direction and are separated in the circumferential direction at the regular intervals. The rear plate 52 is rotatably mounted on the journal portion 49 and is located between the gear 38 and one side faces of the housing member 50 and the rotor 64. The rear plate 52 is provided with three holes which are penetrated in the axial direction and are separated in the circumferential direction at the regular intervals. The front plate 48 is located to be opposite to the other side faces of the housing member 50 and the rotor 64. The front plate 48 is provided with three holes which are penetrated in the axial direction and are separated in the circumferential direction at the regular intervals. Three bolts 54 are fitted into the holes of the front plate 48, the housing member 50 and the rear plate 52 and are screwed into the female screw holes of the gear 38. The front plate 48 is fluid-tightly pressed onto one side face of the housing member 50 and the rear plate 52 is fluid-tightly pressed onto the other side face of the housing member 50. One side face of the rotor 64 is contacted with a stepped portion 49*a* of the journal portion 49 and under this condition a nut 65 is screwed onto the male screw portion 47 of the exhaust cam shaft 34 so as to press the rotor 64 toward the journal portion 49. Thereby, the rotor 64 is fixed with the exhaust cam shaft 34 in a body.

Five chambers 60 which are separated in the circumferential direction at regular intervals and each of which has a pair of circumferentially opposed walls 60*a*, 60*b* are defined among the rotor 64, the housing member 50, the front plate 48 and the rear plate 52. On the outer circumferential portion of the rotor 64, five grooves 70 which extend inwardly therefrom into the radial direction and are separated in the circumferential direction at regular intervals are formed thereon. The five vanes 68 which extend outwardly in the radial direction into the chambers 20 are mounted in the grooves 70, respectively. Thereby, each of chambers 20 is divided into a first pressure chamber 76 and a second pressure chamber 78, both are fluid-tightly separated from each other. As shown in FIG. 3, the inside surface of each of the vane 68 has a groove 72 into which a plate spring 74 is inserted. The plate spring 74 includes a curved portion 74*b* at the center of the plate spring 74. Both ends 74*a* and 74*c* of the plate spring 74 axe attached onto the vane 68 and the curved portion 74*b* of the plate spring 74 is attached onto the rotor 64. Thereby, the vanes 68 are pushed toward outwardly in the radial direction form the rotor 64.

The housing member 50 has a hole 62 which extends inwardly thereof in the radial direction and is penetrated in the radial direction. The bottom end of the hole 62 has a small hole portion 63. The small hole portion 63 accommodates a pin 104 which pushes the rotor 64 forward by a coil spring 106. The pin 104 has a large diameter portion 104*a* engaged in the hole 62 and a small diameter portion 104*b*. The coil spring 106 is supported in the hole 62 by a clip 102. On the other hand, the rotor 30 on the outer circumferential surface has a hole 108 which extends inwardly thereof in the radial direction and the small diameter portion 104*b* of the pin 104 is inserted.

The rotor 64 is provided with six first passages 80 and five second passages 82. One end of the first passages 80 communicates with the first pressure chamber 76 and the hole 64. The other end of the first passages 80 communicates with a main first passage 80*a* which is formed in the exhaust cam shaft 34 at its axial center. On the other hand, one end of the second passages 82 communicates with the second pressure chamber 78. The other end of the second passages 82 communicates with a main second passage 82*a* which is formed in the exhaust cam shaft 34 to be located on the coaxial circle around the axial center of the exhaust cam shaft 34. The main second passage 82*a* extends in parallel in axial direction via the main first passage 80*a*.

A fluid supplying device 91 is comprised of a changeover valve 90, a controller 92 and a fluid pump 96. In this embodiment, the changeover valve 90 is an electromagnetic valve that is a 4 port-3 position type. The fluid pump 96 is driven by the engine and discharges the fluid (oil) for lubricating the engine. The pump 96 may be a pump for lubricating the engine. The position of the changeover valve 90 is controlled by the controller 92 so that a first condition selected to a position 90*a* in which the discharged fluid from the pump 96 is supplied to the main first passage 80*a* and in which the main second passage 82*a* communicates with a reservoir 94, a second condition is selected to a position 90*b* in which the communication between the main passages 80*a*, 82*a* and the pump 96 and the reservoir 94 are interrupted, respectively and in which the discharged fluid from the pump 96 is supplied to the reservoir 94, and a third condition selected to a position 90*c* in which the discharged fluid from the pump 96 is supplied to the second main passage 82*a* and in which the first main passage 80*a* communicates with the reservoir 94 are selectively obtained. The controller 92 controls the above conditions of the changeover valve 90 based on parameter signals depicting the engine speed, the amount of opening of a throttle valve (not shown) and so on.

The operation of the valve timing control device having the above structure will now be described.

When the engine starts, the exhaust cam shaft 34 is rotated in a clockwise direction by the timing pulley 42 in FIG. 2. Thereby, exhaust valves (not shown) are opened and closed. Simultaneously, the rotor 64 is rotated and the gear 38 is rotated via the vanes 68, the housing member 50 and the bolts 54. The rotation of the gear 38 is transmitted to the gear 40 and the intake cam shaft 36 is rotated so that intake valves (not shown) are opened and closed.

The gear 38 is rotatably mounted on the journal portion 49 of the exhaust cam shaft 34. Therefore, when the pressurized fluid is supplied from the pump 96 to the second pressure chambers 78 by changing the changeover valve 90 into the third condition via the main second passage 82*a* and the second pressure passages 82, the housing member 50, the front plate 48 and the rear plate 52 are rotated in the clockwise direction with the gear 38 relative to the exhaust cam shaft 34 in FIG. 2. Thereby, the timing control mechanism 30 is in the position of the maximum advanced condition in which the valves 68 are contacted with the walls **60*b* of the chambers 60. The angular phase of the intake cam shaft 36 is advanced relative to that of the exhaust cam shaft 34 (the crank shaft 43) by maximum valve. At the same time, the small diameter portion 104*b* of the pin 104 is inserted into the hole 108 of the rotor by the coil spring 106**.

In this condition, when the pressurized fluid is supplied from the pump 96 to the first pressure chambers 76 by changing the changeover valve 90 into the first condition via the main first passage **80*a* and the first pressure passages 80, the pressurized fluid urges the pin 104 fully into the hole 52 of the housing member 50. The housing member 50, the front plate 48 and the rear plate 52 are rotated in the counterclockwise direction with the gear 38 relative to the exhaust cam shaft 34 in FIG. 2. Thereby, the timing control mechanism 30 is in the position of the maximum retarded condition in which the valves 68 are contacted with the walls 60*a* of the chambers 60. The angular phase of the intake cam shaft 36 is retarded relative to that of the exhaust cam shaft 34 (the crank shaft 43**) by maximum valve from the above mentioned maximum advanced condition.

Depending on the manner in which the control of the changeover valve 90 is executed, the vanes 68 can be stopped in any position (intermediate advanced position) between the maximum advanced position and the maximum retarded position. This requires that the fluid pressure of the first pressure chambers 76 and the fluid pressure of the second pressure chambers 78 be balanced when the vanes 68 are in an arbitrary position. The amount of the advance can therefore be set to any value between a zero level and a maximum level.

As mentioned above, the opening and closing timing of the intake valves (not shown) driven by the intake cam shaft 36 is adjusted and the angular phase difference between the crank shaft 43 and the intake cam shaft 34 is adjusted.

Figure 4:
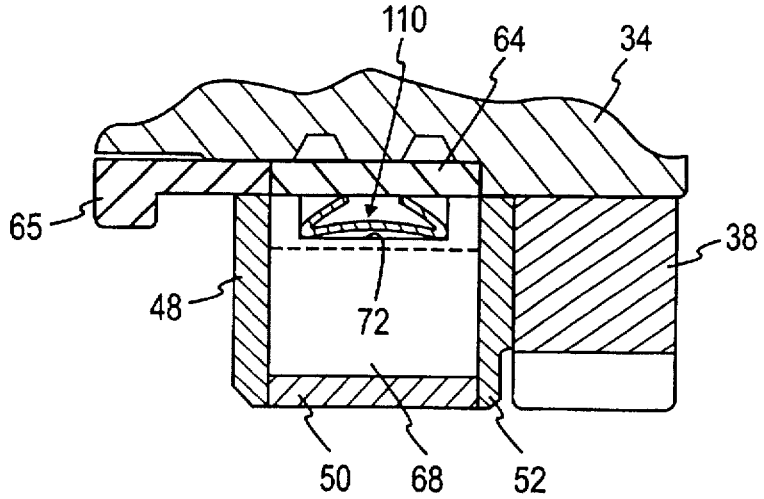
FIG. 4 is an enlarged sectional view of a portion of another modification of a plate spring.
Figure 5A:
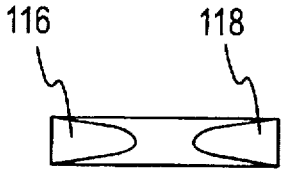
FIG. 5 is a detailed view of a another-modification of a plate spring.
Figure 5B:
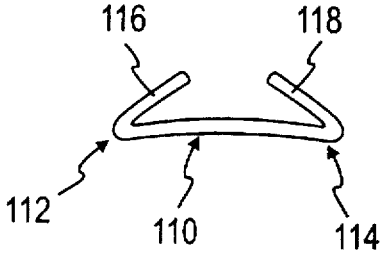

FIG. 4 and 5 illustrates another modification of the first preferred embodiment, especially a modified embodiment of a plate spring 110. In FIG. 4, the same parts as in FIG. 3 are indicated by the same numerals of FIG. 3. In this modified embodiment, the plate spring 110 includes two bending portions 112, 114 as shown in FIG. 5 so that each of the ends 116, 118 of the plate spring 110 are attached onto the rotor 64 and the flat surface between the bending portions 112, 114 of the plate spring 110 is attached onto the vane 68.

Figure 6:
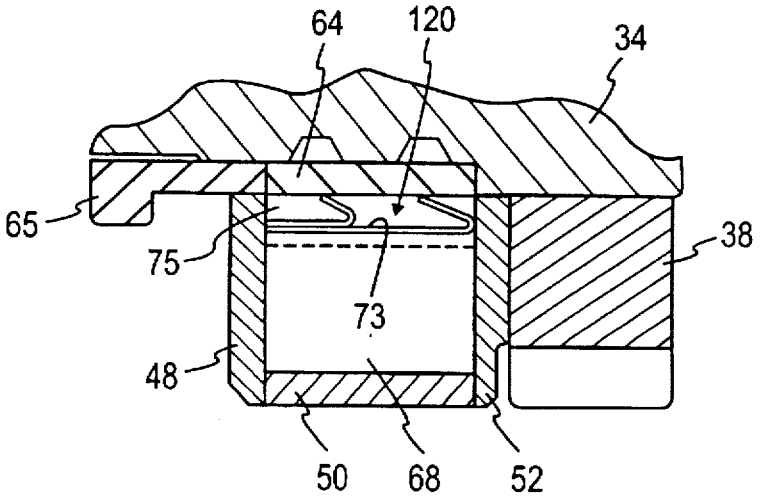
FIG. 6 is an enlarged sectional view of yet another modification of a plate spring.
Figure 7A:
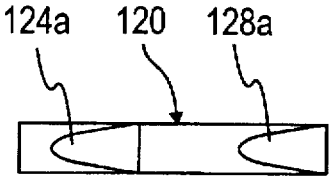
FIG. 7 and FIG. 8 are detailed view of yet another modification of a plate spring.
Figure 7B:
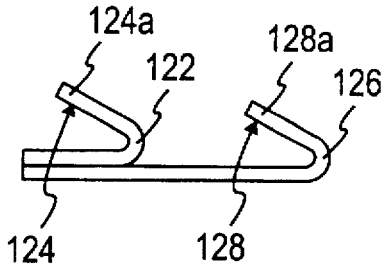
Figure 8A:
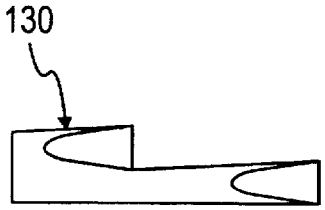
Figure 8B:
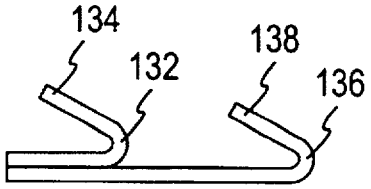

FIG. 6 to 8 illustrates two other modified versions of the first preferred embodiment, especially modified embodiments of plate springs 120 and 130. In FIG. 6, the same parts as in FIG. 3 are indicated by the same numerals of FIG. 3. In this modified embodiment, the inside surface of the each of the vane 68 has a flat surface instead of the groove 72. The plate springs 120 (130) includes two bending portions 122, 126 (132, 136). Two bending portions have the same bending direction as shown in FIG. 7 and FIG. 8. As shown in FIG. 7, the plate spring 120 includes the first bending portion 124 and the second bending portion 128. The first bending portion 124 is put on the second bending portion 128. Two bending pieces **124*a* and 128*a* of the plate spring 120 are attached onto the rotor 64 and the flat surface of the bending piece 128 is attached onto the vane 68. As shown in FIG. 8, the plate spring 130 includes the first bending portion 134 and the second bending portion 138. The first bending portion 134 and the second bending portion 138 are located in parallel with each other. Two bending portions 134 and 138 are attached on the rotor 64 and the flat surface of the plate spring 130 is attached on the vane 68**.

Although the present invention has been fully described in connection with the preferred embodiment thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A valve timing control device comprising:

a rotor on a cam shaft of an engine;

a housing member rotatably mounted on the cam shaft and surrounding the rotor;

a chamber provided between the housing member and the rotor and having a pair of circumferentially opposed walls;

a vane mounted on the rotor and extending outwardly therefrom in the radial direction into the chamber so as to divide the chamber into a first pressure chamber and a second pressure chamber;

a plate spring inserted between the rotor and the vane; and a fluid supplying means for supplying fluid under pressure to at least a selected one of the first pressure chamber and the second pressure chamber.

2. A valve timing control device in claim 1, wherein the vane includes a concave portion located at the plate spring.

3. A valve timing control device in claim 2, wherein the plate spring includes a curved portion.

4. A valve timing control device in claim 3, wherein both ends of the plate spring has a bending portion.

5. A valve timing control device in claim 1, wherein the plate spring has a plurality of bending portions.

6. A valve timing control device in claim 5, wherein the plate spring includes a first plate which has a first bending portion and a second plate which has a second bending portion.

7. A valve timing control device in claim 6, wherein the first bending portion is put on the second bending portion.

8. A valve timing control device in claim 6, wherein the first bending portion and the second bending portion are located in parallel with each other.

* * * * *